US006069434A

United States Patent [19]

Clifford

[11] Patent Number: 6,069,434

[45] Date of Patent: May 30, 2000

[54] MANUFACTURE AND METHOD OF ASSEMBLY FOR A SPARK ELECTRODE

[76] Inventor: Gerald R. Clifford, 15 Strawberry La., Rolling Hills Estates, Calif. 90274

[21] Appl. No.: 08/931,114

[22] Filed: Sep. 16, 1997

[51] Int. Cl.[7] ..... H01T 13/20; H01T 13/04; H01T 13/22; H01T 13/34

[52] U.S. Cl. ..... 313/141; 313/135; 313/136; 313/141; 313/143; 313/144; 313/145; 123/169 R; 123/169 EL; 123/169 PA

[58] Field of Search ..... 445/7; 313/118, 313/128, 135–136, 141, 143, 144, 145; 123/169 R, 169 EL, 169 PA, 44 C, 46 SC, 193, 143 B

[56] References Cited

U.S. PATENT DOCUMENTS

| | | | |
|---|---|---|---|
| 1,953,229 | 4/1934 | Heron | 123/169 |
| 3,753,795 | 8/1973 | Weber | 148/32 |
| 4,081,710 | 3/1978 | Heywood et al. | 313/141 |
| 4,400,643 | 8/1983 | Nishio et al. | 313/11.5 |
| 4,853,582 | 8/1989 | Sato et al. | 313/141 |
| 4,949,687 | 8/1990 | Emmersberger | 123/193 H |
| 5,168,842 | 12/1992 | Brooks | 123/143 C |
| 5,186,132 | 2/1993 | Runge | 123/169 R |
| 5,191,861 | 3/1993 | Kellerman et al. | 123/46 SC |
| 5,303,679 | 4/1994 | Gamon | 123/44 C |
| 5,569,971 | 10/1996 | Clifford et al. | 313/141 |

*Primary Examiner*—Nimeshkumar D. Patel
*Assistant Examiner*—Mack Haynes
*Attorney, Agent, or Firm*—Gene Scott-Patent Law & Venture Group

[57] ABSTRACT

A spark electrode assembly and method of assembling same is disclosed. A ceramic housing having a cylindrical passage provides clearance for a conductive metal electrode. The electrode has a tubular body with rod shaped wires inserted at each end, the wires extending outwardly from the tubular body at each of its ends colinearly. During assembly, the wires are crimped into the tubular body in such a manner that the tubular body is deformed outwardly forming bosses. The bosses are of such a size as to cause an interference fit between the tubular body and the housing passage so that the electrode is captured within the housing. An impact force on the electrode forces the tubular body to expand radially outwardly, thereby further engaging the ceramic housing for holding the electrode in the housing. That part of the electrode body that is not in contact with the housing still has ample room to expand within the housing.

7 Claims, 2 Drawing Sheets

MANUFACTURE AND METHOD OF ASSEMBLY FOR A SPARK ELECTRODE

FIELD OF THE INVENTION

This invention relates generally to spark electrodes and, more specifically, is directed towards a spark electrode construction that allows for simplified assembly of parts that are inexpensive to produce.

BACKGROUND OF THE INVENTION

The following art defines the present state of this field:

Heron, U.S. Pat. No. 1,953,229 describes an invention that relates to spark plug electrodes. This invention provides a spark plug electrode which will resist the corrosion and erosion produced by modern fuels embodying tetraethyl lead and which has a long period of usefulness without requiring replacement or readjustment.

Weber, U.S. Pat. No. 3,753,795 describes a spark plug electrode that is made of a dispersion-strengthened nickel alloy containing small amounts of aluminum and, optionally, chromium.

Heywood et al., U.S. Pat. No. 4,081,710 describes an igniter, particularly for gas turbine engines, and comprising two or more electrodes separated by a body of insulating or semi-conducting material and having exposed working surfaces between which sparks may pass, at least part of the working surface or surfaces of at least one of the electrodes comprising a host material in which Co or Ni predominates alloyed or compounded with one or more additional metals selected from the group consisting of Ru, Rh, Pd, Ir, Pt, Ag and Au. Preferably, the additional metal is platinum which is present in an amount of 1 to 20 wt. % of the total metal content.

Nishio et al., U.S. Pat. No. 4,400,643 describes a spark plug that includes an insulator body with a center bore and a bottom end defining a discharge end of the insulator body and a discharge center electrode formed in a region of the discharge end of the insulator body; a spark plug including thermal conductivity-controlling material comprising spherical metal powder as an essential element thereof in the center bore providing function to control thermal conductivity of the spark plug. The conductivity controlling material further comprises refractory powder and glass powder. The controlling material is also composed of spherical metal powder coated with a ceramic layer of a mixture thereof with the spherical metal powder. The spark plug with the controlling material permits and increasing conductance according to temperature rise to provide a thermally wide-ranged spark plug.

Sato et al., U.S. Pat. No. 4,853,582 describes a spark plug for use in internal combustion engines having a pair of electrodes between which electric spark discharge is effected. The spark plug has a spark discharge portion bonded by, for example, resistance welding to at least one of the electrodes and made of a base metal containing at least 90 wt % of chromium (Cr). A stress-relieving portion having a thermal expansion coefficient intermediate in value between those of the electrode and the spark discharge portion may be formed between the electrode and the spark discharge portion.

My issued patent U.S. Pat. No. 5,569,971 to Clifford et al. defines a spark electrode and method of assembly and is hereby incorporated into this application by reference. In this patent is described an assembly similar to that of the instant disclosure. However, the present invention provides several important advantages over the '971 reference as will be described below.

Almost all spark electrodes, from those used in combustion engine spark plugs to gas heater igniters, have a central metallic conductor housed in a ceramic or glass insulator. A fundamental difficulty with such electrodes has been that the thermal expansion rate of the interior electrode is greater than that of the surrounding ceramic insulator. As such, as the electrode becomes hotter during use and expands, it applies pressure to the inside wall of the insulator. Such ceramic and glass insulators are by their nature extremely brittle, and thus are prone to cracking under thermal expansion pressure from the electrode. A further problem with such prior art devices is that the electrode must be firmly mounted within the housing in such a way that it will not become loose over time. The methods heretofore used for assembling the electrode to the housing are at once expensive and often require more components than just the electrode and ceramic housing.

Prior art devices are available for reducing the chance of structural failure during operation and which provide unique methods for holding the electrode in place within the ceramic housing. Such devices typically teach that the electrode is to be fixed to the ceramic housing by braising processes, or by melting the ceramic or glass housing around the electrode and letting the molten glass set the electrode into place. Other prior art devices teach a spark electrode assembly having multiple parts that cooperate to hold the electrode in place. All of these prior art solutions are relatively expensive, and many require more than two parts. As such, the prior art devices tend to be relatively complex, and thus more expensive and more prone to failure.

Clearly, then, there is a need for a spark electrode device that can be readily assembled and that comprises only the two basic parts of the electrode and the insulating, ceramic housing. Such a needed device would accommodate the thermal expansion of the electrode. Such a needed device would further allow for the thermal contraction of the electrode while still firmly holding the electrode in place within the housing. The present invention fulfills these needs and provides further related advantages such as being very inexpensive to manufacture in scale.

SUMMARY OF THE INVENTION

It is well known in the field of this invention that a seemingly insolvable problem (exists in the use of high voltage high temperature electrodes, i.e., that of providing a high voltage, high temperature insulating covering for an electrical conductor. The problem arises due to the great difference between the thermal coefficient of expansion between the insulator, typically a ceramic material, and the conductor, typically a metal or metallic alloy. The difficulty arises because a solution must be found for mechanically binding the two parts together while allowing for temperature changes which may cause the metal parts to expand and crack the insulator parts. That this is an ongoing and important problem is shown by the significant number of prior art solutions which continue to be presented to the engineering community. The present invention is a spark electrode assembly and method of assembling same that is readily assembled without requiring heating, braising, or adhesive application processes. It is a solution to the above problem that is elegant in its simplicity and has been shown by field tests to completely solve the thermal expansion problem and yet require the lowest cost in both the manufacture, of component parts and the cost of assembly.

The present invention provides a spark electrode assembly and method of assembling the same. A ceramic housing having a cylindrical passage provides clearance for a conductive metal electrode. The electrode has a tubular body with rod shaped wires inserted at each end, the wires extending outwardly from the tubular body at each of its ends colinearly. During assembly, the wires are crimped into the tubular body in such a manner that the tubular body is deformed outwardly forming bosses arranged around the body. The bosses are of such a size as to cause an interference fit between the tubular body and the housing passage so that the electrode is captured within the housing. An impact force on the electrode forces the tubular body to expand radially outwardly, thereby further engaging the ceramic housing for holding the electrode in the housing. That part of the electrode body that is not in contact with the housing still has ample room to expand within the housing.

A primary objective of the present invention is to provide a spark electrode device that is relatively inexpensive to manufacture and assemble.

Another objective is to provide a spark electrode device which allows for the thermal expansion of the electrode without applying significant expansion pressure on the ceramic housing and yet enable the assembly to remain tightly engaged when cool and to provide these important characteristics for many thermal cycles.

A further objective of the invention is to define an electrode that is assembled by staking of parts wherein the staking operation is devised to also produce upsets such that the electrode provides an interference fit within an insulating housing. This dual use of the staking operation provides for inexpensive assembly and low cost.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
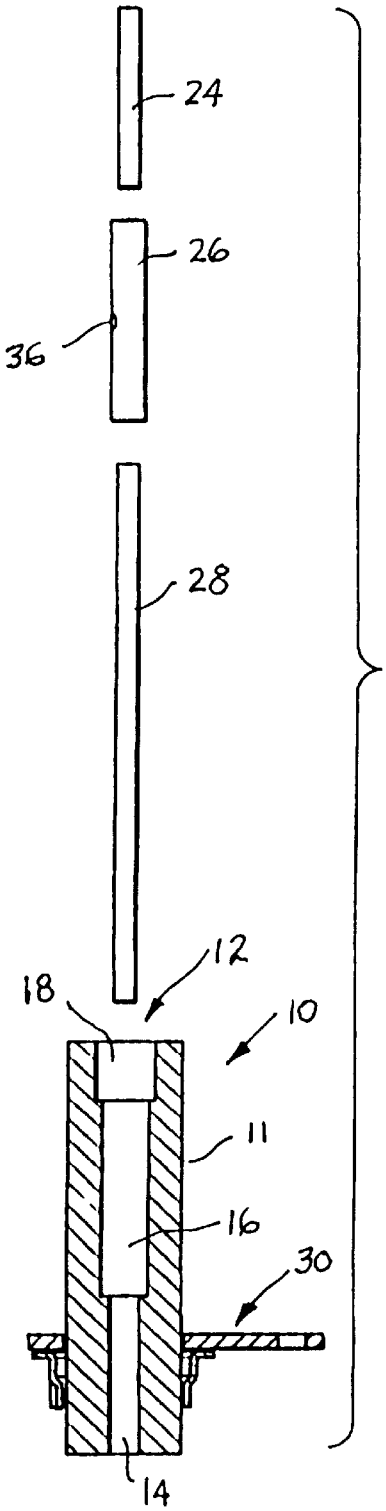
FIG. 1 an exploded side elevational, partially cross-sectioned, view of the invention, illustrating all of the elements of the invention, including the terminal and its crimped cylindrical wall portion.

The above described drawing figures illustrate the invention, a spark electrode device 5 having a housing 10 made of an electrically insulating material, preferably a dense ceramic. The housing 10 has an exterior surface 11 and a cylindrical passage 12. The cylindrical passage 12 comprises, in sequence and mutually concentrically oriented along a longitudinal axis 13, a first clearance portion 14, an interference portion 16, and a second clearance portion 18. The first clearance portion 14 is of a smaller diameter than the interference portion 16. The second clearance portion 18 is of no smaller diameter than the interference portion 16 and is preferably larger as shown. Please note that the second clearance portion 14 is preferably large enough in diameter to accommodate an impact device(not shown), as will be described below.

Figure 6:
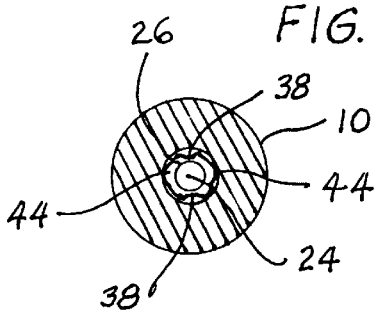
FIG. 6 is a top plan view taken as directed in line 6—6 in FIG. 4.

The spark electrode device 5 also provides an electrode 20, fitted into the cylindrical passage 12. The electrode 20 comprises, in sequence and mutually concentrically oriented along the longitudinal axis 13, an emitter portion 24, an interconnecting portion 26, and a input portion 28. In its preferred embodiment, the emitter portion 24 is a rod and the input portion is an electrical lead wire which may have an insulating jacket covering it, and the interconnecting portion 26 is a sleeve designed to firmly accept the emitter portion 24 and the input portion 28. The emitter and the input portions 24 and 28, are preferably positioned by a locating means such as a dimple 36 within the interconnection portion 26. The emitter and input portions 24 and 28 are preferably secured within the interconnection portion 26 by a plurality of impressions 38 in the interconnection portion 26. The impressions 38 upset an inner surface 40 of the interconnection portion 26, causing the interconnection portion 26 to clamp down on the emitter and input portions 24 and 28 in a typical staking operation. As best seen in FIG. 6 the interconnect portion is shown indented with impressions 38 at an upper (12 o'clock) position and a lower (6 o'clock) position, causing bosses 44 to be formed on the left and right sides of the interconnect portion 26 (3 and 9 o'clock). Alternately impressions may be placed at 90 degree intervals with the bosses forming between them. Clearly, it is seen that multiple bosses are necessary in order to assure strong holding of the electrode within the housing.

The electrode 20 must be made of an electrically conductive material. The emitter portion is preferably made of an alloy containing various combinations of iron, copper, chromium, tungsten, nickel, aluminum, and silicon. It is known in the art that various alloys can be synthesized for desired properties. For guidance in this art, refer to U.S. Pat. Nos. 1,953,229, 3,753,795, 4,314,392 and 4,400,643, herein incorporated in full by reference. The interconnection portion 26 is preferably made of a hard material such as cold-rolled steel or stainless steel. The input portion 28 is typically a high temperature solid or stranded wire with or without insulation. If the input portion 28 has an insulating jacket such would be stripped prior to insertion into the interconnection portion 26.

The impressions 38 are placed and sized to also upset an outer surface 42 of the interconnection portion 26, forming a plurality of outwardly projecting bosses 44, i.e., bulges. Thus, the staking operation causes the outer surface 42 to bulge outwardly between the impressions 38. These bosses 44 are of a size for causing the interconnection portion 26 to have an interference fit within the interference portion 16 of the housing 10. This configuration keeps the interconnection portion 26 securely seated within the interference portion 16 of the housing 10, while simultaneously preventing the thermal expansion of the electrode 20 from creating excessive pressure on the ceramic housing 10. This is critical because a fully tightly fitted metal component such as the electrode 20 would otherwise tend to crack the ceramic housing 10 when the spark electrode device 5 is subjected to the high temperatures present under normal conditions of use within an engine or a burner. Also, the fit must be such as to not loosen when the parts cool, i.e., the metal parts must not compress unduly when at high temperature.

Figure 2:
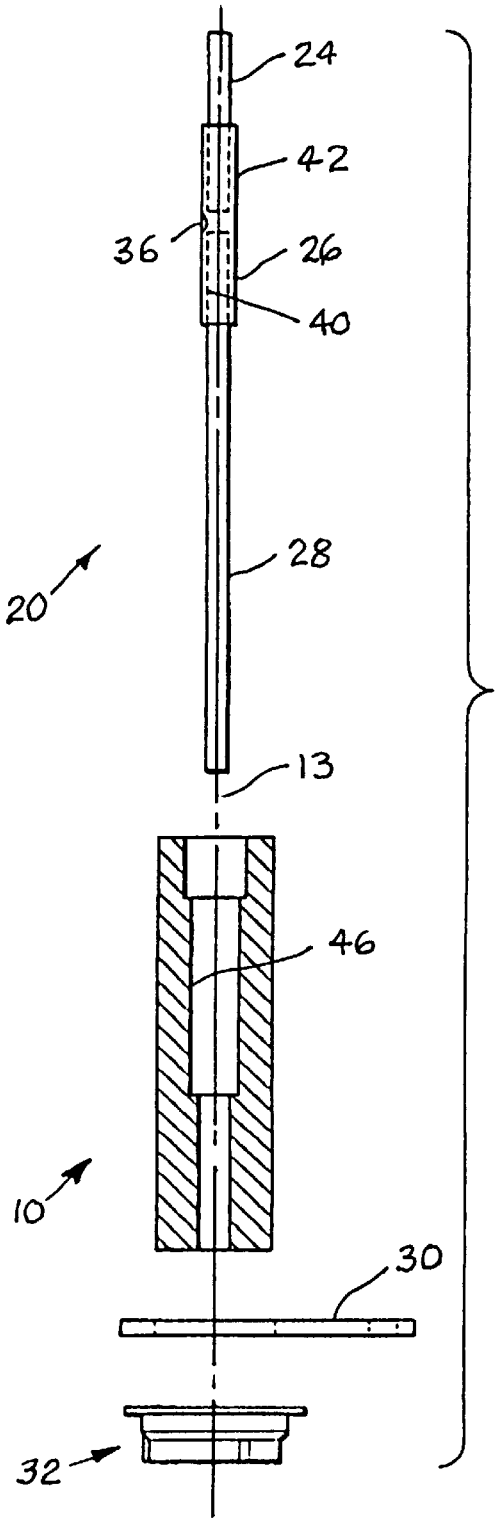
FIG. 2 is an exploded side elevational, partially cross-sectioned, view of the invention, showing an assembled electrode including an interconnecting portion before indentations are made therein.
Figure 3:
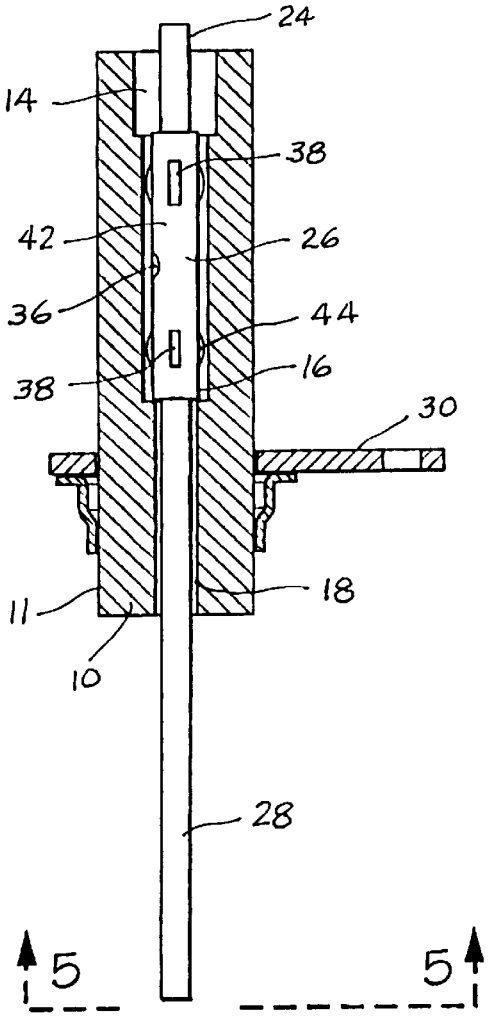
FIG. 3 is a side elevational partially cross-sectioned view of the invention, illustrating the electrode having an interconnecting portion with indentations and bosses after it has been inserted into the cylindrical passage of the housing.
Figure 4:
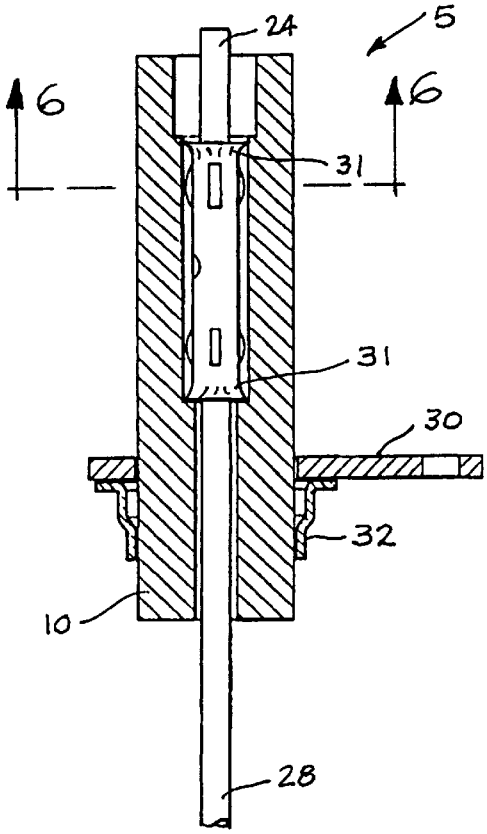
FIG. 4 is a partial cross-sectional view of the invention, illustrating the assembled invention after the electrode has been impacted to form an outward radial flare.
Figure 5:
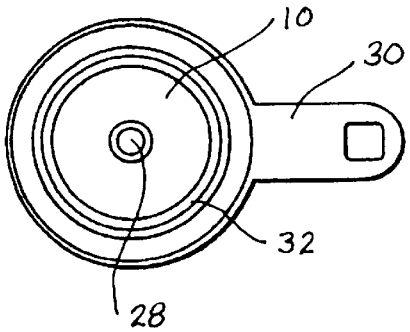
FIG. 5 is a bottom plan view taken as directed in line 5—5 in FIG. 3, illustrating a terminal of the invention.

The emitter, interconnecting portion and input portions 24, 26 and 28, are each primarily positioned within the first clearance, interference, and second clearance portions 14, 16 and 18 respectively, of the housing 10. As previously described, due to the bosses 44, the interconnecting portion 26 has a tightly-fitting relationship with the interference portion 16 of the cylindrical passage 12 enabling permanent engagement of the electrode 20 with the housing 10, the two parts being forced together with some deformation of the bosses occurring. The emitter portion 24 and the input portion 28 are engaged within the interconnection portion 26 and extended outwardly from opposing ends of the housing 10 respectively as clearly shown in FIG. 2.

Preferably, the invention advantageously includes a mounting bracket 30. The bracket preferably includes a cylindrical wall portion 32 concentric with, and adjacent to the housing exterior surface 11. This cylindrical wall portion 32 is then crimped tight to the housing exterior surface 11 for holding the bracket 30 fixedly to the housing 10. The bracket is used to secure the spark electrode device 5 at a desired position or orientation for use. Correct positioning of the spark electrode device 5 is essential because if the emitter portion 24 is not correctly positioned, sparking to grounded portions of nearby associated equipment may occur and even more critical, the emitter portion 24 must be set with a preferred spark gap with respect to a specified ground surface so as to assure proper sparking.

The invention further provides for a second mechanism for securing the electrode 20 within the housing 10. An outward radial flare 31 can easily be formed in one end of the interconnection portion 26 of the electrode 20 during assembly by providing an impact against the input portion end of the interconnection portion 26 of the electrode 20, causing the interconnection portion 26 to flare radially outwardly against an annular interior surface 46 of the interference portion 16 of the housing 10 adjacent to the first clearance portion 14.

The invention also teaches a method of making the above-described spark electrode device 5. The method includes several steps. First, providing a housing 10 made of an electrically insulating material having a cylindrical passage 12 therein, comprising, in sequence and mutually concentrically oriented along a longitudinal axis 13, a first clearance portion 14, an interference portion 16, and a second clearance portion 18, the first clearance portion 14 being of a smaller diameter than the interference portion 16, the second clearance portion 18 being no smaller in diameter than the interference portion 16. Second, providing an electrode 20 comprising an emitter portion 24, an interconnecting portion 26, and a input portion 28, wherein the emitter and input portions, 24 and 28, are rods having a specified diameter and the interconnecting portion 26 of the electrode 20 being formed as a sleeve large enough to firmly accept the rods 24 and 28 with the specified diameter. Third, denting the interconnecting portion 26 to form a dimple 36 at a predetermined location for correct alignment of the emitter portion 24 and the input portion 28. Fourth, inserting the emitter and input portions 24 and 28 into opposing ends of the interconnection portion 26 until they abut the dimple 36. Fifth, crimping the interconnection portion 26 to distort the inner surface 40 of the interconnection portion 26, causing the interconnection portion 26 to have an interference fit within the emitter and input portions 24 and 28. The impressions are placed and sized to also upset an outer surface 42 of the interconnection portion 26, forming a plurality of bosses 44 of a size for causing the interconnection portion 26 to have an interference fit within the interference portion 16 of the housing 10. Sixth, inserting the emitter portion 24 of the electrode 20 into the cylindrical passage 12 so that the emitter, interconnecting and input portions, 24, 26 and 28, are each primarily positioned within the first clearance 14, interference portion 26, and second clearance portion 28, respectively, of the housing. The bosses 44 of the interconnecting portion 26 of the electrode 20 having a interference fit with the interference portion 16 of the cylindrical passage 12 enabling permanent engagement of the electrode 20 with the housing 10. Seventh. impacting the interconnection portion 26 of the electrode 20, causing the interconnection portion 26 to flare radially outwardly against an annular interior surface 46 of the interference portion 16 of the housing 10 adjacent to the first clearance portion 14 so as to further secure the interconnection portion 26 within the interference portion 16 of the housing 10.

The present invention meets all of the objects of this invention by providing a spark electrode which requires only a few basic parts, making the device relatively inexpensive to manufacture and assemble. The bosses 44 in the present device allow for the thermal expansion of the electrode 20 without applying significant expansion pressure on the ceramic housing 10, while simultaneously allowing for the thermal contraction of the electrode 20 without the electrode 20 becoming loose within the housing 10.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A spark electrode device comprising:

a housing made of an electrically insulating material, providing a cylindrical passage therein, comprising, in sequence and mutually concentrically oriented along a longitudinal axis, a first clearance portion, an interference portion, and a second clearance portion, the first clearance portion being of a smaller diameter than the interference portion, the second clearance portion being no smaller in diameter than the interference portion;

an electrode, fitted into the cylindrical passage, and comprising, in sequence and mutually concentrically oriented along the longitudinal axis, an emitter portion, an interconnecting portion, and a input portion, the emitter, interconnecting and input portions each being primarily positioned within the first clearance, interference, and second clearance portions respectively, of the housing, the interconnecting portion of the electrode having a tightly-fitting relationship with the interference portion of the cylindrical passageway enabling permanent engagement of the electrode with the housing;

the interconnecting portion of the electrode being formed as a sleeve, the emitter portion, and the input portions being fixedly engaged within the interconnection portion and extending outwardly from opposing ends of the housing respectively;

the interconnection portion providing a means for positioning the emitter and the input portions within the interconnection portion, the emitter and input portions secured within the interconnection portion by a plurality of inwardly directed impressions in the interconnection portion, the impressions being placed and sized so as to upset an outer surface of the interconnection portion, for causing the interconnection portion to have an interference fit within the interference portion of the housing.

2. The device of claim 1 further comprising a bracket fixedly engaged with the housing and extending away therefrom, the bracket enabled for mounting the device sufficiently for operation thereof.

3. The device of claim 2 wherein the bracket provides a cylindrical wall portion concentric with, and adjacent to the housing exterior surface, the cylindrical wall portion being crimped tightly to the housing exterior surface for holding the electrode fixedly to the housing.

4. The device of claim 1 wherein the interconnection portion of the electrode is flared radially outwardly against an annular interior surface of the interference portion of the housing adjacent to the first clearance portion so as to secure the interconnection portion within the interference portion of the housing.

5. A method of making a spark electrode device comprising the steps of:

providing a housing made of an electrically insulating material having a cylindrical passage therein, comprising, in sequence and mutually concentrically oriented along a longitudinal axis, a first clearance portion, an interference portion, and a second clearance portion, the first clearance portion being of a smaller diameter than the interference portion, the second clearance portion being no smaller in diameter than the interference portion;

providing an electrode comprising an emitter portion, an interconnecting portion, and a input portion, wherein the emitter and input portions are rods having a specified diameter and the interconnecting portion of the electrode being formed as a sleeve large enough to firmly accept the rods with the specified diameter;

denting the interconnecting portion to form a dimple at a predetermined location for enabling preferred depth insertion of the emitter portion and the input portion into the interconnection portion;

inserting the emitter and input portions into opposing ends of the interconnection portion until they abut the dimple;

crimping the interconnection portion at a plurality of opposing locations to distort an outer surface of the interconnection portion forming a plurality of impressions in the interconnection portion, of a size for causing the interconnection portion to have an interference fit with the emitter and input portions, the impressions also being placed and sized so as to cause the formation of a plurality of bosses of a size for causing the interconnection portion to have an interference fit within the interference portion of the housing;

inserting the emitter portion of the electrode assembly into the cylindrical passage so that the emitter, interconnecting and input portions are each primarily positioned within the first clearance, interference, and second clearance portions respectively, of the housing, the bosses of the interconnecting portion of the electrode having a interference fit with the interference portion of the cylindrical passageway enabling permanent engagement of the electrode with the housing, the interconnection portion further extending into the second clearance portion; and impacting the interconnection portion of the electrode, causing the interconnection portion to flare radially outwardly against an annular interior surface of the interference portion of the housing adjacent to the first clearance portion so as to further secure the interconnection portion within the interference portion of the housing.

6. The method of claim 5 further comprising the steps of providing a bracket and fixedly engaging the bracket with the housing.

7. The method of claim 5 further comprising the steps of providing a mounting bracket and fixedly engaging the bracket to the housing.

* * * * *